United States Patent [19]

Dreyer

[11] Patent Number: 4,688,877

[45] Date of Patent: Aug. 25, 1987

[54] SOLDERLESS COAXIAL CONNECTOR

[75] Inventor: Charles W. Dreyer, Fairfield, Conn.

[73] Assignee: Sealectro Corporation, Trumbull, Conn.

[21] Appl. No.: 807,164

[22] Filed: Dec. 6, 1985

Related U.S. Application Data

[63] Continuation-in-part of Ser. No. 523,861, Aug. 18, 1983, Pat. No. 4,557,546.

[51] Int. Cl.[4] ..... H01R 17/18

[52] U.S. Cl. ..... 439/584; 439/431

[58] Field of Search ..... 339/95 A, 177 R E, 276 R, 339/89 C, 90 C, 103 R, 103 B

[56] References Cited

U.S. PATENT DOCUMENTS

| | | | |
|---|---|---|---|
| 3,184,706 | 5/1965 | Atkins | 339/177 R |
| 3,526,871 | 9/1970 | Hobart | 339/177 E |
| 3,544,705 | 12/1970 | Winston | 174/75 |
| 3,757,279 | 9/1973 | Winston | 339/177 R |
| 4,400,050 | 8/1983 | Hayward | 339/177 R |
| 4,441,781 | 4/1984 | Forney, Jr. et al. | 339/177 R |
| 4,575,274 | 3/1986 | Hayward | 339/177 R |

FOREIGN PATENT DOCUMENTS

| | | | |
|---|---|---|---|
| 912672 | 10/1972 | Canada . | |
| 167738 | 1/1986 | European Pat. Off. . | |
| 1958357 | 11/1969 | Fed. Rep. of Germany | 339/177 R |
| 1540617 | 1/1970 | Fed. Rep. of Germany . | |
| 2703306 | 8/1977 | Fed. Rep. of Germany . | |
| 7113815 | 1/1972 | France . | |
| 2224894 | 10/1974 | France . | |
| 387524 | 3/1933 | United Kingdom . | |
| 832186 | 4/1960 | United Kingdom . | |
| 928336 | 6/1963 | United Kingdom . | |
| 1306653 | 2/1973 | United Kingdom . | |
| 1400362 | 7/1975 | United Kingdom . | |
| 1452346 | 10/1976 | United Kingdom . | |

*Primary Examiner*—Gil Weidenfeld
*Assistant Examiner*—David Pirlot
*Attorney, Agent, or Firm*—Anthony J. Casella; Gerald E. Hespos

[57] ABSTRACT

An assembly is provided for releasably joining a semi-rigid coaxial cable to a coaxial connector. The assembly includes an outer clamping sleeve which slides over and compresses an inner clamping sleeve against the cable. The inner clamping sleeve includes at least one array of internal threads. A coupling nut is threaded onto the coaxial connector and urges the inner and outer clamping sleeves into telescoping relationship, thus compressing the inner clamping sleeve against the cable. The inner clamping sleeve includes slots to facilitate compression and grooves to facilitate clamping of the cable.

15 Claims, 10 Drawing Figures

SOLDERLESS COAXIAL CONNECTOR

RELATED APPLICATIONS

This application is a continuation-in-part of U.S. patent application Ser. No. 523,861 filed Aug. 18, 1983 by Charles W. Dreyer and entitled Solderless Coaxial Connector now U.S. Pat. No. 4,557,546, dated Dec. 10, 1985.

BACKGROUND OF THE INVENTION

Coaxial cables comprise an inner conductor, an outer conductor concentrically disposed around the inner conductor and a non-conducting insulation uniformly disposed therebetween. The cables may or may not include an outer insulation. Coaxial cables are used in many applications where it is necessary to carry radio frequency or microwave frequency electrical signals. Coaxial cables often are employed in high vibration environments such as in ground, air or marine vehicles, weapons systems and many machines.

Coaxial cables must maintain their symmetry while in use. Variations in coaxial symmetry can create an impedance or a phase shift which can have a substantial degrading effect on the electrical signal carried by the cable. To maintain symmetry at an electrical connection, the ends of the coaxial cable typically are joined to coaxial cable connectors which are designed to have a minimum effect on the signal. Coaxial cable connectors may be used to join one cable to another or to join a coaxial cable to an electrical device. The connectors may take the form of a plug or a socket. Furthermore the connectors may be straight or angled relative to the axis of the cable.

The coaxial cable connector should be able to maintain a secure, high quality, radio frequency or microwave frequency connection in all environments in which the connector is used. More particularly, the coaxial cable connector should not permit either longitudinal or rotational movement of the cable relative to the connector despite forces exerted on either the cable or the connector.

One type of coaxial cable includes a center conductor, a symmetrical insulation, such as Teflon, surrounding the center conductor, and a semi-rigid tubular outer conductor, with no insulation extending around the tubular outer conductor. These semi-rigid tubular outer conductor coaxial cables can be joined to coaxial cable connectors by soldering. Although soldered connections are widely used, they present several significant problems. Specifically to make the soldered connection, both the tubular outer conductor and the connector must be heated sufficiently to cause the solder to melt and wick into the area between the two members. This heat causes the insulation to expand, and the expansion can cause a permanent deformation of the tubular outer conductor, with a resultant detrimental effect on the signal-carrying performance of the coaxial cable. In extreme instances the heat generated to melt the solder can damage nearby electrical components.

Solderless connectors for tubular outer conductor coaxial cables avoid problems attributable to soldering heat. However, solderless connectors have required a mechanical deformation of the outer conductor. For example, the cable may be inserted into a bushing or sleeve which then is placed in a special tool which crimps both the sleeve and the cable sufficiently to mechanically interengage the two. The crimped sleeve then can be force fit into another part of the connector. This deformation of the outer conductor has a substantial detrimental effect on the signal carried by the cable. If the connector is to be used in an environment with severe temperature, shock and vibration conditions, the size of the crimp must be further increased with an even greater degrading effect on electrical performance.

Other solderless coaxial connectors have been developed which rely on substantial compression rather than crimping. However, the net effect is the same in that the geometry of the cable changes with a resultant effect on electrical performance. The available crimping and compression solderless connectors require special tools to mechanically deform the outer conductor of the cable. These tools typically are quite expensive, and if not used properly can twist and permanently damage the cable. Additionally, crimping, compression and soldering all are permanent conditions. Thus it is difficult or impossible to disconnect, shorten and reconnect the cable in order to achieve a desired precise phase length.

Solderless connectors that avoid crimping and that avoid or minimize compression have been developed. However, the prior art connectors of this type have not provided a high quality RF or microwave frequency connection in all environments and have exhibited a tendency to move either axially or rotationally in response to external forces of vibrations. Certain prior art coaxial connectors have included gripping members that twist helically when compressed, thereby altering symmetry and electrical performance. Still other solderless coaxial connectors are costly to manufacture and/or include a large number of parts, thereby making assembly difficult.

In view of the above it is an object of the subject invention to provide a connector for semi-rigid tubular outer conductor coaxial cables which does not require soldering or other application of heat to the cable or the connector.

It is another object of the subject invention to provide a solderless coaxial connector for tubular outer conductor coaxial cables which does not require special tools and can be connected by hand or with a standard wrench.

It is an additional object of the subject invention to provide a solderless coaxial connector for tubular outer conductor coaxial cables which does not significantly affect the electrical performance at radio frequency or microwave frequency.

It is a further object of the subject invention to provide a solderless coaxial connector for tubular outer conductor coaxial cables which does not crimp or otherwise substantially deform the cable.

It is yet another object of the subject invention to provide a solderless coaxial connector for tubular outer conductor coaxial cables which can be easily disconnected and reconnected.

It is still an additional object of the subject invention to provide a solderless coaxial connector for tubular outer conductor coaxial cables which can be employed under severe conditions of temperature, shock, and vibration.

Another object of the subject invention is to provide a solderless coaxial connector which prevents axial and rotational movement relative to the cable.

Still another object of the subject invention is to provide a clamping sleeve for use with a solderless coaxial cable to securely grip the cable.

SUMMARY OF THE INVENTION

The solderless coaxial connector of the subject invention may define either a male plug or a female jack or socket, and may be incorporated into a straight or a right angle connector. In all of these possible forms, the subject solderless coaxial connector includes a generally cylindrical inner clamping sleeve which is telescopingly slid over one end of a tubular outer conductor coaxial cable, and is compressed radially inwardly into secure engagement with the outer conductor by an outer clamping sleeve. More particularly the inner clamping sleeve includes one end which is chamferred to an angle of approximately 30° with respect to the longitudinal axis. The chamfer thus defines major and minor outer diameters. A location on the inner clamping sleeve spaced longitudinally from the chamfered end includes a circumferential stop with a diameter less than the diameter of the coaxial cable. As a result, the inner clamping sleeve can be mounted on one end of the coaxial cable, but will not slide along the length of the cable. The circumferential stop may define a longitudinal end of the inner clamping sleeve, or alternatively the stop may be intermediate the chamfer and a socket end of the inner clamping sleeve, as explained herein.

The inner clamping sleeve includes an inside surface that is roughened from a point substantially adjacent the chamfer to a point at least intermediate the two ends of the inner clamping sleeve. Preferably this roughening comprises a series of parallel annular grooves. Alternatively, the roughening may comprise standard helical threads. However, it has been found that with helical threads alone there is possibility of the inner clamping sleeve twisting off the coaxial cable on which it is mounted when used in high vibration environments.

To further prevent movement between the inner clamping sleeve and the cable, the inside surface of the inner clamping sleeve can also be provided with a second array of grooves that intersect the annular or helical grooves. In a preferred embodiment, this second array defines generally longitudinally extending grooves. The second array of grooves is especially effective in preventing relative rotation between the inner clamping sleeve and the cable, and thus compliments the annular or helical grooves on the inside surface of the inner clamping sleeve. Furthermore these longitudinally extending grooves prevent the relative twisting that could be a problem with an inner clamping sleeve having only a helical groove. Thus, the combination of a helical groove and a plurality of longitudinal grooves can provide an effective electrical connection, can be manufactured easily and inexpensively and will provide effective resistance to both longitudinal and rotational movement between the cable and the inner clamping sleeve.

The number and pattern of grooves in the inner clamping sleeve will vary in accordance with design specifications as explained herein. However, in most instances longitudinal grooves will be spaced between 15° and 45° from one another, and preferrably between 15° and 30°. This spacing will enable adequate gripping without defining sharp ridges or points that could adversely deform the outer conductor and affect the electrical signal.

To facilitate the radial compression of the inner clamping sleeve, at least one slot is provided in the inner clamping sleeve. Preferably the inner clamping sleeve includes a pair of slots which define a plane aligned to the longitudinal axis at an angle of between 10° and 60°. The width of each slot should be sufficient to enable both a clamping compression of the inner clamping sleeve and a slight deformation of the tubular outer conductor into the slot.

The outer clamping sleeve also is generally cylindrical, and has an inside diameter which is less than the major diameter of the chamfer on the inner clamping sleeve, but greater than the minor diameter. Thus, when the inner and outer clamping sleeves are moved toward one another, the outer clamping sleeve slides over the chamfer, and compresses the inner clamping sleeve into clamping engagement with the tubular outer conductor of the coaxial cable. As an alternative to the above, the chamfer may be on the inner surface of the outer clamping sleeve.

To achieve the interengagement of the inner and outer clamping sleeves, a threaded coupling means is used in combination with a standard coaxial plug or jack connector. One end of the coupling means has threads for engagement with an appropriate coaxial connector, while the other end is adapted to retain the outer clamping sleeve. Preferably the outer clamping sleeve is retained in the coupling means by a locking ring which enables the outer clamping sleeve to rotate, but limits longitudinal movement. Thus, the outer clamping sleeve will not rotate as the coupling means is threaded onto the coaxial connector, thereby minimizing friction as the inner and outer clamping sleeves are telescopingly nested and preventing twisting of the inner clamping sleeve. In an alternate embodiment coupling means and outer clamping sleeve may be an integral member.

Prior to mounting the subject connector to the coaxial cable, the cable preferably is trimmed such that the center conductor extends longitudinally beyond the insulation and the tubular outer conductor. It is also preferred that the center conductor be trimmed to a well defined point to further facilitate coupling. This trimmed center conductor can be inserted into the center conductor socket on a coaxial cable connector, or can be inserted into a female socket member of the inner clamping sleeve, as explained below.

In use, the coupling means can be slid over the tubular outer conductor coaxial cable such that the threaded end of the coupling means is nearest the trimmed end of coaxial cable. The inner clamping sleeve then can be slid over the end of the coaxial cable such that the end thereof having the slots is nearest the coupling means. The coupling means then can be threadably attached to an appropriate coaxial connector plug or jack. As the coupling means axially advances toward the connector the inner and outer clamping sleeves also advance toward one another such that the outer clamping sleeve is at least partially telescopingly received over the chamferred end of the inner clamping sleeve. This telescoping relationship between the inner and outer clamping sleeves causes the roughened inner surface of the inner clamping sleeve to be pressed inwardly against the tubular outer conductor. Although hand tightening of the coupling nut provides a sufficient clamping interengagement for most functions, it is preferred that the coupling nut be securely tightened with a standard wrench or other similar hand tool. Tightening of the coupling nut with a wrench causes at least a minor deformation of the tubular outer conductor into the slot, which contributes to symmetry and thus improved performance at high frequencies.

DETAILED DESCRIPTION OF THE PREFERRED EMBODIMENT

Figure 1:
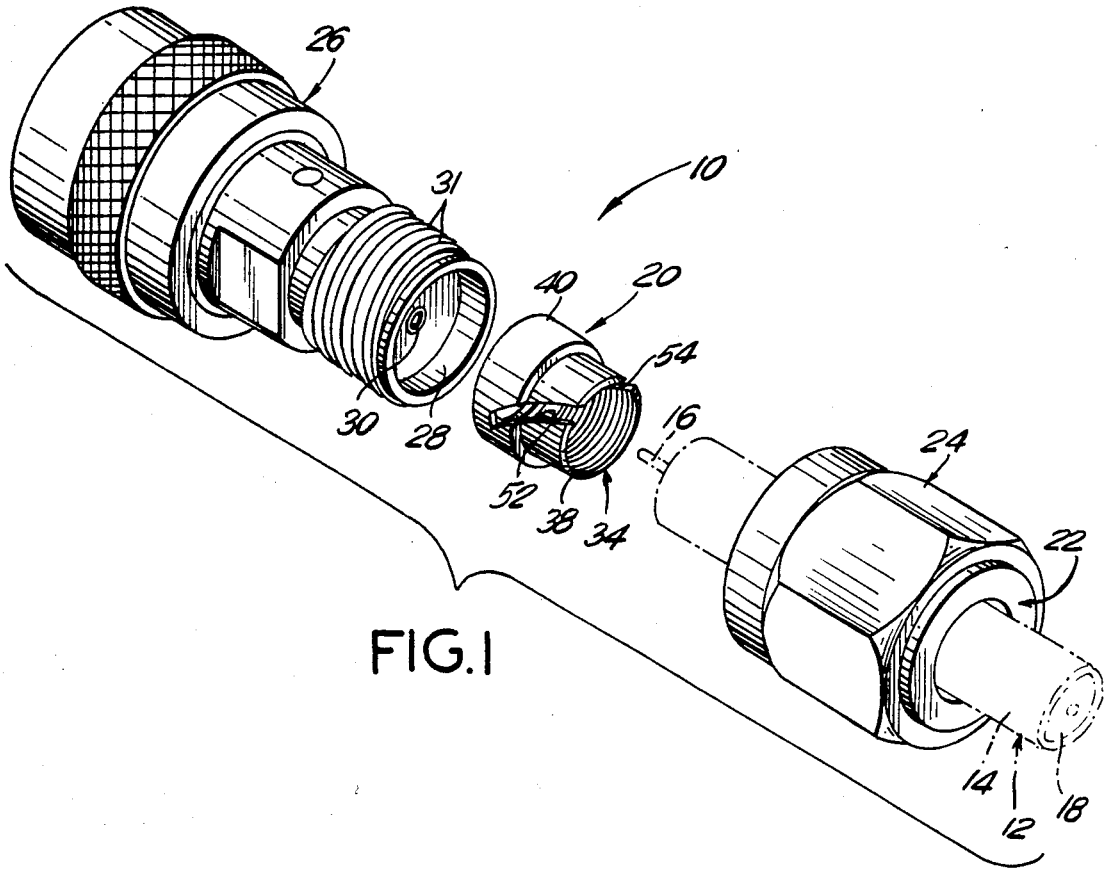
FIG. 1 is an exploded perspective view of the solderless coaxial connector of the subject invention.

The solderless coaxial connector of the subject invention is indicated generally by the numeral 10 in FIG. 1. More particularly the solderless connector 10 is constructed to be securely mounted on a semi-rigid tubular outer conductor coaxial cable 12. The coaxial cable 12 includes a tubular outer conductor 14 and a center conductor 16 which are coaxially disposed with respect to one another, and are separated by an insulator 18, such as Teflon. Preferably, the coaxial cable 12 is prepared for use with the subject solderless connector 10 by stripping the outer conductor 14 and insulation 18 away from the center conductor 16, and sharpening the stripped end of the center conductor 16.

The solderless connector 10 includes an inner clamping sleeve 20, an outer clamping sleeve 22 and a coupling nut 24 adapted for use with a coaxial connector 26. The coaxial connector 26 includes an outer socket 28 for electrically contacting the tubular outer conductor 14 and an inner socket 30 for electrically contacting the center conductor 16. Threads 31 are disposed around the outside of the outer socket 31 as shown in FIG. 1. As explained in greater detail below, the outer clamping sleeve 22 is mounted in the coupling nut 24 so as to be rotationally moveable therein, while having relative longitudinal movement between the outer clamping sleeve 22 and the coupling nut 24 limited. Additionally, both the inner and outer clamping sleeves 20 and 22 are dimensioned to telescopingly slide onto the coaxial cable 12 and to at least partially telescopingly nest within one another.

Figure 2:
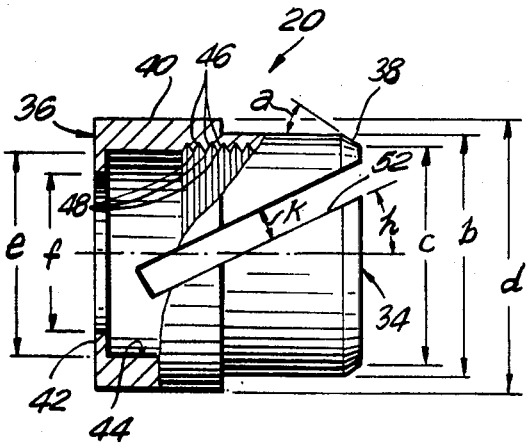
FIG. 2 is a cross-sectional side view of the inner clamping sleeve of the solderless coaxial connector shown in FIG. 1.
Figure 3:
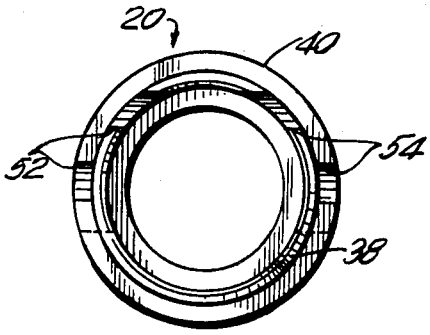
FIG. 3 is an end view of the inner clamping sleeve of the solderless coaxial connector shown in FIG. 1.
Figure 4:
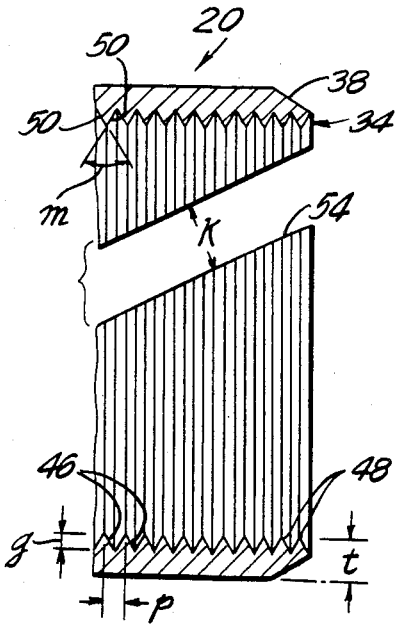
FIG. 4 is a second cross-sectional view of the inner clamping sleeve of the solderless coaxial connector shown in FIG. 1.

The inner clamping sleeve 20, as illustrated most clearly in FIGS. 2 through 4, is generally cylindrical, and includes opposed clamping and connecting ends 34 and 36. The clamping end 34 is defined by a chamfer 38 which extends circumferentially around the inner clamping sleeve 20. Preferably the chamfer is formed with an angle "a" of approximately 30°. Thus the chamfer 38 defines a major diameter "b" and a minor diameter "c" at the clamping end 34 of inner clamping sleeve 20. The inner clamping sleeve 20 is sufficiently thin at the clamping end 34 to be readily compressed radially inward against the coaxial cable 12. Specifically the material at the clamping end 34 preferably should be about 0.010 inches thick, as shown by dimension "t" in FIG. 4.

The connecting end 36 of the inner clamping sleeve 20 is defined by an enlarged collar 40 and a circumferential ledge 42. The outside diameter "d" of the collar 40 is substantially equal to the inside diameter of the outer socket 28 on coaxial connector 26. The greater thickness adjacent collar 40 substantially prevents deformation of the connecting end 36 as a result of compression at clamping end 34 and also defines a limit for the telescoping between the inner and outer clamping sleeves 20 and 22. The inside diameter "e" of the inner clamping sleeve 20 is substantially equal to the diameter of the coaxial cable 12. Additionally, the inner diameter "f" defined by the ledge 42 is less than the diameter of the coaxial cable 12. As a result of this construction the clamping end 34 may be slid over the stripped end of the coaxial cable 12. However the ledge 42 effectively stops the inner clamping sleeve 20 from sliding along the length of the coaxial cable 12. Furthermore, the above defined dimensions ensure that the coaxial cable 12 and the inner clamping sleeve 20 may be slid into the connector 26 without affecting the electrical signal.

The inner surface 44 of the inner clamping sleeve 20 is defined by a plurality of substantially parallel annular grooves 46 defining parallel clamping ridges 48 therebetween. Preferably each annular groove 46 has a depth "g" of 0.0040 inches plus or minus 0.0005 inches. The annular grooves 46 and annular clamping ridges 48 each are defined by intersecting planar surfaces 50 which are separated from one another by angle "m" shown in FIG. 4, which is approximately 60°. Also as shown in FIG. 4, adjacent annular clamping ridges 48 are separated from one another by distance "p" which is approximately equal to 0.005 inches. As explained further herein, the annular clamping ridges 48 enable secure clamping with the outer tubular conductor 14 of the coaxial cable 12.

The inner clamping sleeve 20 further includes a pair of slots 52 and 54 which extend in a common plane angularly through the inner clamping sleeve 20, from the clamping end 34 to a point intermediate the two ends of the inner clamping sleeve 20. Preferably, the slots 52 and 54 extend to a point beyond the clamping ridges 48 and the collar 40 and to or beyond the point where the plane of slots 52 and 54 intersects the center line of the inner clamping sleeve 20. The slots 52 and 54 are provided to facilitate the radially inward compression of the clamping end 34 against the coaxial cable 12, thus enabling the annular clamping ridges 48 to securely grasp the outer conductor 14. However the termination of slots 52 and 54 at a point intermediate the ends of inner clamping sleeve 20 prevents significant or nonsymmetrical deformation of the inner clamping sleeve 20.

The angle "h" between the plane of slots 52 and 54 and the longitudinal axis of the inner clamping sleeve 20 preferably is between 15° and 30°, with the precise angle being at least partly dependent upon the diameter of the coaxial cable 12 with which the subject inner clamping sleeve 20 is used. Specifically, the angle "h" preferably is greater for a larger diameter coaxial cable 12. As an example on a 0.85 inch cable, the angle "h" preferably is approximately 20°. For a 0.141 inch cable, the angle "h" is preferably about 25°.

The width of slots 52 and 54, as indicated by dimension "k", also preferably varies directly with the size of the cable 12. For example the 0.085 inch cable preferably will include a slot having a width of 0.020 inches, while a 0.141 inch diameter cable preferably will be used with an inner clamping sleeve 20 having slots 52 and 54 with a width of 0.025 inches. In all instances, the width of slots 52 and 54 should be sufficient to enable slight deformation of the outer tubular conductor 14 into the slots 52 and 54. This deformation both enhances the gripping power of the inner clamping sleeve 20 and minimizes the degradation of the electric signal carried through the solderless connector 10.

Figure 5:
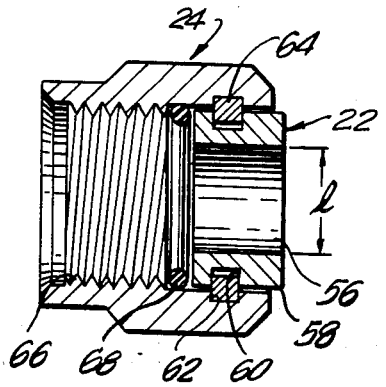
FIG. 5 is a cross-sectional view of the coupling nut and outer clamping sleeve of the solderless coaxial connector shown in FIG. 1.

Turning to FIG. 5 the outer clamping sleeve 22 and the coupling nut 24 are shown in their interlocked condition. The outer clamping sleeve 22 includes an inner cylindrical surface 56 which defines a diameter "l" which is greater than the minor diameter "c" but less than the major diameter "b" defined by the chamfer 38 on the inner clamping sleeve 20. As explained below, these dimensional relationships enable the outer clamping sleeve 22 to slide over the chamfer 38 on the inner clamping sleeve 20, thereby compressing the clamping end 34 of the inner clamping sleeve 20 inwardly.

The outer cylindrical surface 58 of the outer clamping sleeve 22 includes an annular notch 60. A similar notch 62 is disposed on the inner surface of the coupling nut 24. Locking ring 64 is disposed in the notches 60 and 62 to substantially prevent longitudinal movement of the outer clamping sleeve 22 with respect to the coupling nut 24. The fit between the locking ring 64 and the notches 60 and 62 is sufficiently loose to enable the outer locking sleeve 22 to rotate freshly within the coupling nut 24. The coupling nut 24 further includes an array of internal threads 66 which are adapted to engage the external threads 31 on the coaxial connector 26. An O-ring is disposed in the coupling nut 24 intermediate the outer claping sleeve 22 and the threads 66. The o-ring 68 prevents penetration by moisture.

Figure 6:
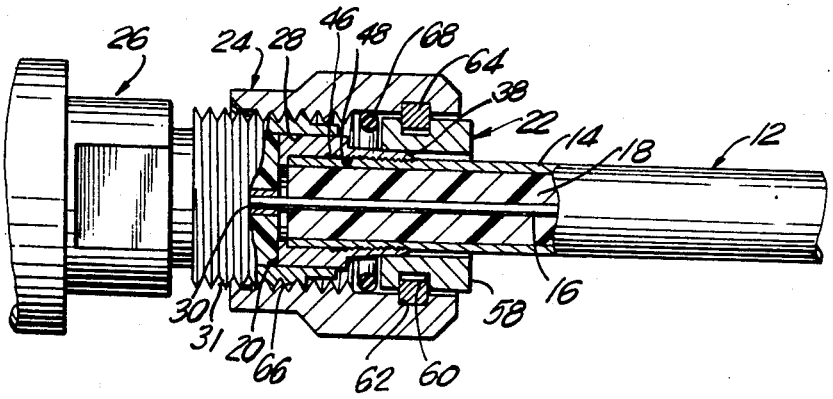
FIG. 6 is a cross-sectional view of the assembled solderless coaxial connector shown in FIG. 1.

The solderless connector 10 is assembled into clamping engagement with the coaxial cable 12 as shown in FIGS. 1 and 6 by first sliding the combined outer clamping sleeve 22 and coupling nut 24 over the end of the coaxial cable 12 which has been stripped as described above. More particularly, combined outer clamping sleeve 22 and coupling nut 24 are slid onto the coaxial cable 12 such that the outer clamping sleeve 22 is most distant from the stripped end of the coaxial cable 12.

The inner clamping sleeve next is slid over the stripped end of the coaxial cable 12, and is moved longitudinally and telescopingly along coaxial cable 12 until the ledge 42 contacts the tubular outer conductor 14 and the insulation 18 of coaxial cable 12.

The coaxial cable 12 then is inserted into the coaxial connector 26 such that the center conductor 16 adjacent the stripped end of the coaxial cable 12 enters the center socket 30 on the coaxial connector 26. This longitudinal movement of the coaxial cable 12 and coaxial connector 26 toward one another also causes the collar 40 of the inner clamping sleeve 20 to enter the outer socket 28. The solderless connector 10 is fastened into this connected condition by first advancing the coupling nut 24 longitudinally over the end 34 of the inner clamping sleeve 20 and threadably engaging the threads 66 of coupling nut 24 with the threads 31 of the coaxial connector 26. As the coupling nut 24 is tightened on into the coaxial connector 26 the outer clamping sleeve 22 contacts the chamfer 38 of the inner clamping sleeve 20. Continued rotation of coupling nut 24 causes an axial movement of the outer clamping sleeve 22 toward and along the chamfer 38 of the inner clamping sleeve 20 which in turn causes a progressive inward compression of the inner clamping sleeve 20. This compression is facilitated by the slots 52 and 54. In this regard, it is noted that the angular alignment of slots 52 and 54 with respect to the longitudinal axis substantially ensures a symmetrical compression of the inner coupling sleeve 20.

As the inner clamping sleeve 20 is compressed inwardly the annular clamping ridges 48 are used into contact with the tubular outer conductor 14 of the coaxial cable 12. This radially inward force imposed by the annular clamping ridges 48 substantially prevents the coaxial cable 12 from being slipped out of engagement with the inner and outer clamping sleeves 20 and 24. Simultaneously the locking ring 64 and the socket 28 of the coaxial connector 26 substantially eliminate any possibility of the inner and outer clamping sleeves 20 and 22 being slid out of engagement with either the coaxial connector 26 or the coupling nut 24. Furthermore the threaded connection between the coupling nut 24 and the coaxial connector 26 substantially eliminates any possibility of the coupling nut 24 and the coaxial connector 26 from being separated from one another. Thus it is seen that the various members of the solderless connector 10 cooperate with one another to ensure a good electrical connection under virtually all operating conditions.

In many instances hand tightening of the coupling nut 24 onto the coaxial connector 26 is sufficient. However in many environments and for high frequency signals, it is desirable to utilize a wrench to mechanically tighten the coupling nut 24. As noted above, this tightening of coupling nut 24 causes a slight deformation of the tubular outer conductor 14 into the slot 52 and 54, thereby contributing to both the mechanical strength and the electrical quality of the connection.

It has been found that when the solderless connector 10 is employed as described above in connection with 0.141 inch diameter semi-rigid coaxial cable, the connection withstands a pull test of approximately 125 lbs. Similarly when the solderless connector 10 is employed with semi-rigid coaxial cable having a diameter of 0.085 inches, the connection can withstand a pull test of approximately 100 lbs. In addition to these mechanical strength characteristics of the connection, it has been found that the connection is able to meet most relevant U.S. military specifications for electrical performance.

Figure 7:
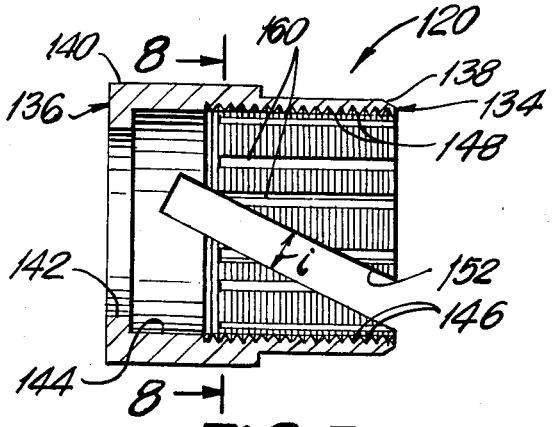
FIG. 7 is a cross-sectional side view of a second embodiment of the inner clamping sleeve.

An alternate embodiment of the inner clamping sleeve is shown in FIG. 7, and is identified generally by the numeral 120. The inner clamping sleeve 120 is similar to the inner clamping sleeve 20 illustrated in FIGS. 1 through 4 and described above. More particularly, the inner clamping sleeve 120 includes opposed clamping and connecting ends 134 and 136 respectively. The claming end 134 is defined by a chamfer 138 which facilitates the telescopingly nesting of the inner clamping sleeve 120 with a corresponding outer clamping sleeve (not shown). The inner clamping sleeve 120 further includes an enlarged collar 140 adjacent the connecting end 136 thereof. An inwardly extending annular ledge 142 also is disposed adjacent the connecting end 136 to limit the axial movement of the inner clamping sleeve 120 relative to a cable. The inside surface 144 of the inner clamping sleeve 120 is defined by a plurality of grooves 146 which extend from the clamping end 134 of the inner clamping sleeve 120 to a point intermediate the opposed ends thereof. The grooves 146 are depicted as defining an array of parallel generally annular grooves. However, it is to be understood that in this particular embodiment the grooves 146 may define a helical array. Clamping ridges 148 are defined in the inside surface 144 between adjacent grooves 146.

The inner clamping sleeve 120 further includes slots 152 and 154 which are similar to the slots 52 and 54 described above with reference to the inner clamping sleeve 20. More particularly, the slots 152 and 154 lie in a common plane which extends from the clamping end 134 to or beyond a point that intersects the center line of the inner clamping sleeve 120. The slots 152 and 154 have a width "i" with dimensions substantially equal to the width "k" of slots 52 and 54 described above. As explained above, the slots 52 and 54 facilitate the inward symmetrical compression of the inner clamping sleeve and enable the clamping ridges 146 to securely engage a cable mounted therein. The employment of the inner clamping sleeve 120 in the solderless coaxial connector 10 described above enables the clamping ridges 146 thereof to securely grasp the outer conductor of the semi-rigid coaxial cable. This grasping of the cable by the ridges 146 substantially prevents relative axial movement between the inner clamping sleeve 120 and a cable. However, it has been found that in certain environments the forces and/or vibrations imposed on either the solderless coaxial connector 10 or the cable mounted thereto are likely to cause relative rotation between the cable and the inner clamping sleeve 120. Although this relative rotational movement generally is not as detrimental as relative axial movement between the cable and the connector, the relative rotational movement can have a degrading effect on the electrical signal.

Relative rotational movement between the cable and the inner clamping sleeve 120 is prevented by a plurality of longitudinally extending, spaced apart, parallel clamping grooves 160. The grooves preferably have a depth "g" substantially equal to the depth of the annular grooves 46 and 146 described above. More particularly, the grooves 160 are approximately 0.0040 inches deep, plus or minus 0.0005 inches. Furthermore, the longitudinal grooves 160 are defined by planar surfaces 162 which intersects one another at an angle "m" substantially equal to the angle defined by the surfaces forming the annular or helical grooves 40 or 146. More particularly, the angle "m" defined by the intersecting surfaces 162 is approximately equal to 60°.

Figure 8:
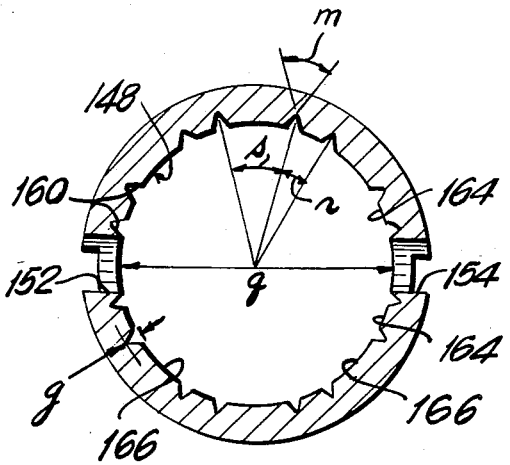
FIG. 8 is a cross-section along line 8—8 in FIG. 7.

As shown most clearly in FIG. 8, the spacing between the grooves 160 is not constant. More particularly, it has been found that for an inner clamping sleeve 120 having an inner diameter "q" of approximately 0.89 inches, the most effective clamping is achieved with a total of sixteen longitudinal grooves 160, with the grooves 160 being alternately separated from one another by an angle "r" of approximately 15° or an angle "s" of approximately 30°. As a result of this spacing, clamping surfaces 164 and 166 are defined around the inner circumference of the inner clamping sleeve 120. The clamping surfaces 164 extend through an arc of approximately 15°, while the clamping surfaces 166 extend through an arc of approximately 30°. It should be emphasized, that the clamping surfaces 164 and 166 approach an axial length of zero as dicated by the relatively well defined points of the annular or helical clamping ridges 148. Thus, a plurality of clamping surfaces are defined on the inside surface 144 of the inner clamping sleeve 120, wherein each clamping surface is very short in an axial direction, but extends through an arc of at least approximately 15° in a circumferential direction. This unique structure securely grasps the coaxial cable to prevent both axial and rotational movement between the cable and the inner clamping sleeve 120. Furthermore, the significant arc defined by the longitudinal clamping ridges 164 and 166 avoids the formation of sharp points that could otherwise create a significant and permanent deformation in the outer conductor of the coaxial cable.

Figure 9:
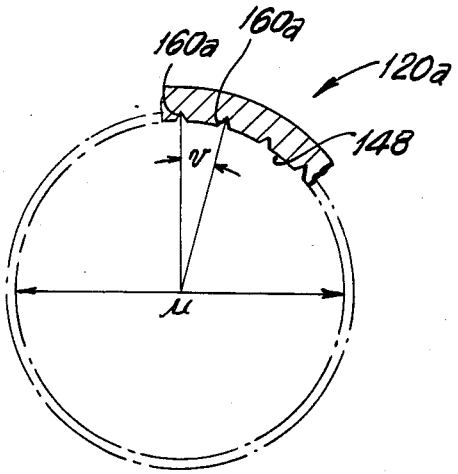
FIG. 9 is a cross-section similar to FIG. 8 but showing a third embodiment of the inner clamping sleeve.

FIG. 9 shows a slightly different embodiment of the inside surface of an inner clamping sleeve 120*a*. More particularly, the inner clamping sleeve 120*a* shown in FIG. 9 has an inside diameter "u" of approximately 0.143 inches, and has substantially uniform angular spacing between the longitudinal grooves 160*a* of approximately 15° as indicated by angle "v". Thus, the inner clamping sleeve 120*a* having an inside diameter "u" of approximately 0.143 inches has a total of 24 equally spaced longitudinal ridges around its inside surface. This greater number of ridges has been found to have a greater ability to resist rotational movement between the inner clamping sleeve 120*a* and the slightly larger cable to be secured therein.

Figure 10:
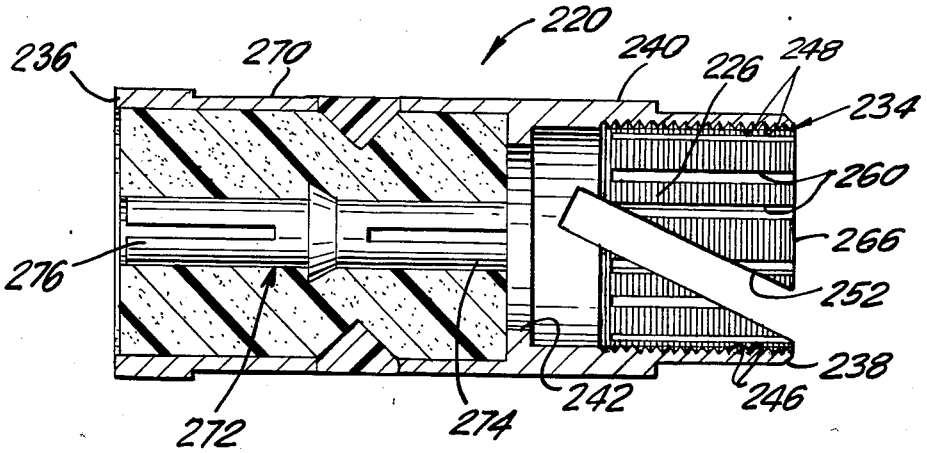
FIG. 10 is a cross-sectional side view of a fourth embodiment of the inner clamping sleeve.

FIG. 10 shows a slightly different embodiment of the inner clamping sleeve which is indicated by the numeral 220. More particularly, the inner clamping sleeve 220 includes a clamping end 234 and an opposed connecting end 236. The clamping end is defined by a chamfer 238 which is substantially identical to the chamfers 138 and 38 described above. An enlarged collar 240 extends from the connecting end 236 to a point intermediate the opposed ends of the inner clamping sleeves 220. Additionally, an inwardly extending annular ledge 242 is disposed intermediate the opposed ends of the inner clamping sleeve 220 to limit the axial movement between the inner clamping sleeve 220 and the cable. The annular or helical grooves 246 and ridges 248 and the longitudinal grooves 260 and ridges 266 are substantially the same as the similarly numbered grooves and ridges described and illustrated with respect to FIGS. 7–9. Similarly, the slot 252 in the inner clamping sleeve 220 is substantially identical to the slot 152 described above. However, the inner clamping sleeve 220 includes a connecting end 236 that is significantly different from the connecting ends 136 or 36 described above. More particularly, the connecting end 236 includes an outer conductor portion which extends from the annular ledge 242 to the extreme connecting end 236 of the inner clamping sleeve 220. An inner female contact member 272 is provided to engage the inner conductor of a coaxial cable mounted in the clamping end 234 of the inner clamping sleeve 220. The inner female contact member 272 further includes a jack portion 276 for engagement with an appropriate connector or cable. An insulating material is disposed intermediate the female contact member 272 and the outer conductor 270. The clamping function of the inner clamping sleeve 220 is substantially identical to the clamping function of the inner clamping sleeves 120 and 20 described above.

The longitudinal grooves 160, 160*a* and 260 illustrated in FIGS. 7 through 10 can be formed by a broach advanced into the inner clamping sleeve after the formation of the annular or helical groove 146 or 246. As explained above, the longitudinal grooves 160, 160*a*, 260 substantially prevent rotational movement between the inner clamping sleeve 120*a*, 220 and a cable mounted therein. In view of this prevention of rotational movement, the grooves 146 can be formed in a helical array instead of a non-helical annular array. More particularly, the presence of the longitudinal grooves 160, 160*a*, 260 and the ridges formed therebetween substantially prevents the unthreading that is possible with an inner clamping sleeve having only helical threads on the inside surface. Thus, an array of helical grooves 146, 246 and an array of longitudinal grooves 160, 160*a*, 260 can cooperate with one another to prevent both longitudinal movement and rotational movement when the solderless coaxial connector is subjected to vibrations and/or any of a variety of external forces. Furthermore, helical grooves are considerably easier and less expensive to form than a comparable array of non-helical annular grooves.

In summary, a solderless electrical connector is provided which enables inner and outer clamping sleeves to be partially telescopingly nested within one another such that the inner clamping sleeve is compressed inwardly into secure engagement with the coaxial cable. The inner and outer clamping sleeves are generally cylindrical in construction. The inner clamping sleeve includes a chamferred clamping end which is dimensioned to facilitate the initial telescoping entry into the outer clamping sleeve. The inside surface of the inner clamping sleeve comprises a plurality of annular or helical grooves and may further comprise a plurality of longitudinal grooves. The grooves prevent movement between the clamping sleeve and the cable. Compression of the inner clamping sleeve is further facilitated by at least one slot which preferably is angularly aligned with respect to the longitudinal axis. The outer clamping sleeve is mounted in a coupling nut such that rotation is permitted, but longitudinal movement is restricted. The combined coupling nut and outer clamping sleeve are first placed onto an end of the coaxial cable such that the end of the coupling nut having the outer clamping sleeve furthest away from the end of the coaxial cable to be connected. The inner clamping sleeve then is slid unto the coaxial cable such that the chamfer is nearest the coupling nut. The coaxial cable then is inserted into the coaxial connector and the coupling nut and coaxial cable are threadably connected to one another. This threadable connection advances the outer clamping sleeve over the chamfer of the inner clamping sleeve causing the inner clamping sleeve to be compressed into clamping engagement with the coaxial cable.

While the subject invention has described and shown with respect to a preferred embodiment, it is understood that the invention should only be limited by the scope of the attached claims.

What is claimed is:

1. An assembly for releasably joining one end of a semi-rigid coaxial cable to a coaxial connector, said coaxial connector including an array of threads, said assembly comprising:

an inner sleeve for mounting generally concentrically around the cable, said inner sleeve including generally cylindrical inner and outer surfaces and opposed clamping and connecting ends, the diameter of said cylindrical inner surface being substantially equal to the diameter of said cable, said cylindrical inner surface including an inwardly extending annular ledge adjacent the connecting end of said inner sleeve for limiting the axial movement of the inner sleeve relative to the cable, said inner cylindrical surface including a plurality of annular grooves extending from said clamping end to a point intermediate said clamping and connecting ends, said plurality of annular grooves defining annular clamping ridges therebetween, and a plurality of generally longitudinal grooves defining generally longitudinal clamping ridges therebetween, said inner sleeve further including a pair of angularly aligned slots extending from the clamping end thereof to a point intermediate the clamping and connecting ends, said inner sleeve being compressable into secure engagement with the cable adjacent said slots and said clamping ridges of said inner sleeve;

an outer sleeve for telescopingly sliding over the clamping end of the inner sleeve to progressively compress the inner sleeve;

coupling means for threadably engaging the coaxial connector and for limiting movement of the inner and outer sleeves along the cable; and a locking ring mounted intermediate said outer sleeve and said coupling means, said locking ring enable rotable movement between said outer sleeve and said coupling means, but preventing relative axial movement between said outer sleeve and said coupling means.

2. An assembly as in claim 1 wherein said slots are between 0.020 and 0.025 inches wide.

3. An assembly as in claim 1 wherein said clamping end is chamferred to facilitate the telescoping sliding of said outer sleeve over said inner sleeve.

4. An assembly as in claim 1 wherein each said annular and generally longitudinal groove has a depth of between approximately 0.0035 inches and 0.0045 inches.

5. An assembly as in claim 1 wherein said slots extend through substantially the entire portion of said inner sleeve on which said grooves are disposed.

6. An assembly as in claim 1 wherein the slots lie in a common plane , and wherein said plane is aligned at an angle of between 15° and 30° with respect to the axis of the inner sleeve.

7. An assembly as in claim 6 wherein the plane defined by said slots extends from the clamping end of the inner sleeve to a point where said plane intersects the longitudinal axis of said inner sleeve.

8. A clamping sleeve for use with a solderless coaxial connector to releasably engage one end of a semi-rigid coaxial cable, said clamping sleeve comprising generally cylindrical inner and outer surfaces and opposed clamping and connecting ends, the diameter of said cylindrical inner surface being substantially equal to the diameter of said cable, said cylindrical inner surface including an inwardly extending annular ledge spaced from the clamping end thereof for limiting the axial movement of said inner clamping sleeve relative to the cable, said inner cylindrical surface including an array of generally annular grooves extending from said clamping end to a point intermediate said clamping and connecting ends, said inner cylindrical surface further including a plurality of generally longitudinal grooves extending into said inner cylindrical surface from said clamping end to a point intermediate said clamping and connecting ends, and being spaced from one another by between approximately 15° and 30°, said generally longitudinally extending grooves and said generally annular grooves defining a plurality of spaced apart clamping surfaces therebetween, each said clamping surface having a very short axial length and a circumferential length of between approximately 15° and 30°, said inner sleeve further including two slots extending entirely through said clamping sleeve from the clamping end thereof to a pair of points intermediate the clamping and connecting ends, said slots defining a plane aligned to and intersecting the longitudinal axis at an angle, such that a chord between said two slots at the clamping end is on one side of the longitudinal axis of the inner sleeve and such that at least one other chord intersecting said pair of points is on the opposite side of the longitudinal axis from said clamping end chord whereby said clamping sleeve is compressible into engagement with the cable such that the clamping surfaces thereof engage the cable to substantially prevent relative longitudinal and rotational movement between the clamping sleeve and the cable.

9. A clamping sleeve as in claim 8 wherein the generally annular grooves and the generally annular clamping ridges therebetween define a generally helical array of clamping grooves and ridges.

10. A clamping sleeve as in claim 8 wherein said slots comprise a pair of slots defining a plane aligned to the longitudinal axis at an angle of between 15° and 30°.

11. A clamping sleeve as in claim 10 including between approximately 16 and 24 longitudinally aligned clamping grooves.

12. An assembly for releasably joining one end of a semi-rigid coaxial cable to a coaxial connector, said assembly comprising:

an inner clamping sleeve for mounting generally concentrically around the cable, said inner clamping sleeve including opposed inner and outer surfaces and opposed clamping and connecting ends, said inner surface defining a diameter substantially equal to the diameter of said cable, said inner surface including an inwardly extending annular ledge spaced from the clamping end thereof for limiting axial movement between said inner sleeve and said cable, said inner surface including an array of generally annular clamping grooves and an array of generally longitudinal clamping grooves, said arrays of generally annular and generally longitudinal clamping grooves extending from the clamping end to a pair of points intermediate said clamping end and said ledge, said generally annular grooves and said generally longitudinal grooves being disposed to define a plurality of spaced apart clamping surfaces, each said clamping surface having an axial length approaching zero and a circumferential length of between approximately 15° and 30°, said inner clamping sleeve further including a pair of slots extending from the clamping end to a point intermediate said clamping end and said ledge, said slots defining a common plane angularly aligned to and intersecting the longitudinal axis of said inner clamping sleeve such that a chord between said two slots at the clamping end is on one side of the longitudinal axis of the inner sleeve and such that at least one other chord intersecting said pair of points is on the opposite side of the longitudinal axis from said clamping end chord;

an outer clamping sleeve dimensioned to telescopingly slide over the clamping end of the inner clamping sleeve and to progressively compress the inner clamping sleeve; and coupling means for engaging the coaxial connector and for effecting limited movement of the inner and outer sleeves relative to each other and to the cable.

13. An assembly as in claim 12 wherein the generally annular clamping grooves and the generally annular clamping ridges define a helical array of clamping grooves and clamping ridges.

14. An assembly as in claim 12 wherein the generally annular clamping grooves and the generally annular clamping ridges are defined by intersecting generally planar surfaces.

15. An assembly as in claim 12 wherein said inner clamping sleeve further includes a longitudinally aligned female contact extending between the ledge thereof and the connecting end.

* * * * *